US006869076B1

(12) United States Patent
Moore et al.

(10) Patent No.: US 6,869,076 B1
(45) Date of Patent: Mar. 22, 2005

(54) CASINO LOW BALL GAME AND METHOD OF DEALING CARDS THEREIN

(75) Inventors: James Chyvan Moore, Cathedral City, CA (US); Ann Marie D'Amico, Palm Springs, CA (US)

(73) Assignee: D'Amico and More Enterprises, Inc., Palm Springs, CA (US)

( * ) Notice: Subject to any disclaimer, the term of this patent is extended or adjusted under 35 U.S.C. 154(b) by 0 days.

(21) Appl. No.: 10/604,642

(22) Filed: Aug. 6, 2003

Related U.S. Application Data

(60) Provisional application No. 60/430,985, filed on Dec. 4, 2002.

(51) Int. Cl.[7] ..... A63F 9/24

(52) U.S. Cl. ..... 273/292; 463/13

(58) Field of Search ..... 463/1, 12–13; 273/274, 292, 296, 303, 306

(56) References Cited

U.S. PATENT DOCUMENTS

| | | | | | |
|---|---|---|---|---|---|
| 3,796,433 | A | | 3/1974 | Fraley et al. | 273/138 |
| 4,887,819 | A | * | 12/1989 | Walker | 273/256 |
| 5,275,416 | A | * | 1/1994 | Schorr et al. | 273/292 |
| 5,294,128 | A | * | 3/1994 | Marquez | 273/292 |
| 5,395,120 | A | * | 3/1995 | Malek | 273/292 |
| 5,494,295 | A | * | 2/1996 | Potter et al. | 273/292 |
| 5,632,485 | A | | 5/1997 | Woodland et al. | 0273/292 |
| 5,664,781 | A | * | 9/1997 | Feola | 273/292 |
| 5,810,354 | A | * | 9/1998 | Banyai | 273/292 |
| 5,810,663 | A | | 9/1998 | Bochichio et al. | 463/13 |
| 5,813,673 | A | * | 9/1998 | Richardson | 273/292 |
| 5,911,419 | A | | 6/1999 | Delaney et al. | 273/292 |
| 5,928,081 | A | | 7/1999 | Bochichio et al. | 463/13 |
| 6,017,033 | A | | 1/2000 | Keller | 273/292 |
| 6,135,453 | A | * | 10/2000 | Srichayaporn | 273/292 |
| 6,210,279 | B1 | | 4/2001 | Dickinson | 463/37 |
| 6,220,597 | B1 | * | 4/2001 | Scibetta | 273/292 |
| 6,264,200 | B1 | * | 7/2001 | Smith | 273/274 |
| 6,270,078 | B1 | * | 8/2001 | Leone et al. | 273/292 |
| 6,283,474 | B1 | | 9/2001 | de Keller | 273/274 |
| 6,322,075 | B1 | | 11/2001 | DeFranco | 273/274 |
| 6,406,020 | B1 | * | 6/2002 | Reed | 273/274 |
| 6,435,505 | B1 | | 8/2002 | Hoffman | 273/274 |
| 6,485,020 | B1 | | 11/2002 | Broadnax | 273/292 |
| 6,523,830 | B1 | | 2/2003 | Yuan | 273/292 |
| 6,547,246 | B2 | * | 4/2003 | Webb | 273/292 |
| 2002/0037765 | A1 | * | 3/2002 | Johnson | 463/17 |
| 2002/0043766 | A1 | * | 4/2002 | Berman | 273/292 |
| 2002/0195775 | A1 | | 12/2002 | Webb et al. | 273/292 |
| 2003/0032471 | A1 | * | 2/2003 | Darder | 463/16 |
| 2003/0054873 | A1 | * | 3/2003 | Peterson | 463/20 |
| 2003/0071415 | A1 | * | 4/2003 | Huard et al. | 273/274 |
| 2003/0153380 | A1 | * | 8/2003 | Dreaper et al. | 463/16 |

FOREIGN PATENT DOCUMENTS

| | | |
|---|---|---|
| GB | 2 239 811 | 7/1991 |

OTHER PUBLICATIONS

Scarne's Encyclopedia of Card Games, p. 40, 1983.*

* cited by examiner

*Primary Examiner*—Michael O'Neill
(74) *Attorney, Agent, or Firm*—Stephen Christopher Swift; Swift Law Office

(57) ABSTRACT

A low ball game and a method of dealing cards in the game. A standard deck of 52 playing cards plus one joker is used. Aces count as one. The players bet that the value of the highest card in their hand will not exceed a number from 1 through 9. However, a bet on a number must include all the higher numbers, and a minimum bet includes the numbers 5 through 9. The lower the number bet, the higher the pay-off if the player wins. A first embodiment uses actual physical cards that are dealt onto a table. Each player is given a square that is divided into nine smaller squares, numbered 1 through 9, with the single payout shown above the number and the cumulative payout shown below the number. A second embodiment for an electronic gaming machine displays similar rectangles and the cards on a video screen.

8 Claims, 5 Drawing Sheets

| Hand | Average Win | Win % | Frequency | Payoff | Return | House Edge |
|---|---|---|---|---|---|---|
| 9 low | $19.58 | 22.554 | 1 in 4.434 | 4 for 1 | 90.21% | 9.79% |
| 8 low | $4.36 | 13.974 | 1 in 7.156 | 7 for 1 | 97.82% | 2.18% |
| 7 low | $5.34 | 8.111 | 1 in 12.329 | 12 for 1 | 97.33% | 2.67% |
| 6 low | $9.92 | 4.320 | 1 in 23.148 | 22 for 1 | 95.04% | 4.96% |
| 5 low | $7.86 | 2.044 | 1 in 48.924 | 47 for 1 | 96.07% | 3.93% |
| *Total for 5-9 low* | $47.06 | | | | | 4.71% |
| 4 low | $8.14 | 0.813 | 1 in 123.001 | 118 for 1 | 95.93% | 4.07% |
| *Total for 4-9 low* | $55.20 | | | | | 4.60% |
| 3 low | $9.68 | 0.244 | 1 in 409.836 | 390 for 1 | 95.16% | 4.84% |
| *Total for 3-9 low* | $64.88 | | | | | 4.63% |
| 2 low | $15.14 | 0.043 | 1 in 2,326 | 2,150 for 1 | 92.43% | 7.57% |
| *Total for 2-9 low* | $80.02 | | | | | 5.00% |
| 1 low | $48.78 | 0.0017075 | 1 in 58,565 | 30,000 for 1 | 51.23% | 48.78% |

FIG. 3

CASINO LOW BALL GAME AND METHOD OF DEALING CARDS THEREIN

CROSS REFERENCE TO RELATED APPLICATIONS

This application is based on Provisional Patent Application Ser. No. 60/430,985, filed Dec. 4, 2002.

BACKGROUND OF INVENTION

1. Field of the Invention

The present invention relates to card games, specifically "low ball" poker games, and methods for dealing them, either physically or by electronic representations.

2. Description of the Prior Art

Poker has been a popular card game for more than a century. Today, hundreds of card rooms and casinos provide poker rooms for players to play against other players. These are considered class two games by the gaming industry. (Class two games are games in which the players bet against each other.) At the start of each poker hand, players have only a vague idea of how many bets it may cost to play the hand through to the end. Various games require from two to five betting intervals, with three to five raises usually allowed.

With just a five-dollar minimum bet, a single hand could cost forty to one hundred fifty dollars to see the hand through to the end. Even if a player wins the bet, their return for bets invested is highly uncertain.

The more bets a player places in the pot, the greater the mental stress becomes in making decisions to continue calling bets to the end of the hand. This pressure often causes players to loose their mental control. Their method of play and money management can completely disintegrate. A fun game suddenly becomes a disaster filled with stress.

For the foregoing reasons, only a small percentage of casino patrons ever enter the poker room. The majority of casino patrons are seeking relaxation and enjoyment for their gambling dollar.

Games that require just one bet per hand are much less stressful to play. Therefore, some players seek out games such as blackjack, craps or mini-baccarat. These are the most favorable games for the player, when played correctly. They minimize the up and down fluctuations of the player's chips. This, in turn, leads to more sound mental control.

Other players seek out the elusive large payments for small bets that slot machines appear to offer. However, their money usually dwindles away, unless they hit a lucrative payout or two. In the last decade a large variety of new games have appeared in the casino pit areas. Most of these new games are considered class three games by the gaming industry. (Class three games are games in which the players bet against the house.) A common feature seems to dominate most new games. Their inventors tend to cede overwhelming odds to the casinos, much to the detriment of the players. They seem to feel that this feature will cause their games to be more readily accepted by the casinos looking for quick profits.

Variations of class three poker games seem to be the most appealing to adventurous players. However, the most knowledgeable poker players avoid these games. They quickly realize that the lopsided rules favoring the casinos leave them virtually no chance to win. A large percentage of these poker games require the dealer to have a reasonably good starting hand to "qualify" playing against the players' hands. In most instances, this qualifying rule will encompass close to half of all hands received.

Players are required to place their first bet after receiving their poker hand. Additional bets are required, or they loose their first bet. It is at this point that the dealer's qualifying rule places the greatest pressure on the players. Slightly under 50% of the time, the value of a player's hand dictates folding their hand and giving up their bet. The sub-par value of their hand has no chance of winning additional bets, whether the dealer qualifies or not. When the dealer's hand does qualify, slightly over 50% of the time the player loses all bets.

If the player receives a hand better than the minimum hand the dealer requires to qualify, placing additional bets might be in order. However, risking additional bets still has more negatives than positives. Almost half the time, the player receives no payoff for the extra bets at risk, each time the dealer does not qualify. On the other hand, when the dealer does qualify, it becomes a virtual toss-up whether the dealer or the player will win. At best, this break even chance occurs 30% of the time. The player is clearly the underdog on all other occasions.

Overall, the rules tend to place the player in a no-win situation. A long shot straight flush or better is the player's best hope to walk away a winner. The average chance of this happening is about 65,000 to one.

The unfavorable rules for the player seem to destine players to lose from the moment they place their first bet. Some players realize that their best choice is to concede their losses and leave quickly. Others allow these types of table games to destroy their mental control and exhaust their chips. Facing one dilemma after another, they have no chance to relax and enjoy themselves. Any chance of having a good time quickly disappears. Worst of all, when a player loses mental control, the Automatic Teller Machines are always too close by.

The present invention is designed to help alleviate many of the distressing decisions players face in most of these recently created table games. It is based on the game of low ball poker. Years ago, the first low ball poker games was invented. "Low ball" means that the worst poker hand is the winner. The worst possible hand was 7-5-4-3-2, disallowing any ace high, pairs, three or four of a kind, straights and flushes.

When California low ball became the dominant low ball game, a 5-4-3-2-A was deemed the lowest possible hand, with an ace or joker being counted one. Since this hand was a five high straight, it was decided that all straights and flushes would be of no consequence in declaring the lowest hand. This concept generally became accepted for most low ball games, including high-low split games, seven-card stud, hold-em, and Omaha poker. This created more exciting possibilities for these games, thereby developing more betting action.

The present inventors have conceived an original idea to create even more exciting possibilities in the low ball games of the present invention, by declaring pairs and three or four of a kind to be of no consequence in determining the best low hand. The instant invention uses this modified low hand poker count in a class three game.

The prior art low ball games create nine basic possibilities for low hands: King low, Queen low, Jack low, ten low, nine low, eight low, seven low, six low, and five low. With pairs (and three or four of a kind) of no consequence, four additional possibilities are created for low hands: four low, trey (or three) low, deuce (or two) low, and Ace (or one) low (four aces or three aces and a joker). This establishes thirteen basic low hands in total.

This game is further modified (in its preferred embodiments) to deal four-card poker hands instead of the standard five-card poker hands. This produces more frequents winnings for the players, when they place from five to nine separate bets on low hands of nine or less. All such bets must be in equal amounts, except (in the first preferred embodiment) for the one low bet, which will be fifty cents only.

The primary purpose of this game is to provide the players with a chance to relax and enjoy themselves. To this end, the game provides a single betting interval at the start of each hand. No additional betting or other decisions are required of the players to complete the hand. The game also provides the players a chance to win large payouts for relatively small bets.

There have been numerous prior inventions of casino and card games, but none that are equivalent to the present invention.

U.S. Pat. No. 3,796,433, issued on Mar. 12, 1974, to Walter C. Fraley, James T. Hendrix and Charles A. Bell, discloses an electronic gaming device simulating the game of blackjack.

U.S. Pat. No. 5,632,485, issued on May 27, 1997, to Bill W. Woodland and Linda M. Woodland, discloses a card game with side bet options, which may be played either on a game board or on an electronic gaming device. Wagers are placed after an initial display of two cards. The instant invention is distinguishable, in that all four cards are displayed at one time.

U.S. Pat. No. 5,810,663, issued on Sep. 22, 1998, to Joseph V. Bochichio and Robert S. Pinchbeck, discloses a method of playing a high/low card game, in which three cards are dealt to each player and four cards to the dealer. Only low hands of six low or less have any value as a low hand. Pairs, three of a kind, and three-card straights and flushes do not count as low hands. The instant invention is distinguishable, in that it is strictly a low ball game, and it includes an array on nine squares.

U.S. Pat. No. 5,911,419, issued on Jun. 15, 1999, to Thomas A. Delaney and Bennett M. Wilgard, discloses a method and apparatus for playing bettor's choice draw poker, including rectangular playing areas on a table. The instant invention is distinguishable, in that the hands are ranked differently, and it uses a different betting system.

U.S. Pat. No. 5,928,081, issued on Jul. 27, 1999, to Joseph V. Bochichio and Robert S. Pinchbeck, discloses a high/low card game, in which there are several rounds of dealing and betting. The instant invention is distinguishable, in that it includes only one round of dealing and betting.

U.S. Pat. No. 6,017,033, issued on Jan. 25, 2000, to Claude Keller, discloses a method of playing a casino game, which rewards a player for how quickly he can "lose". The instant invention is distinguishable, in that it does not include the use of a timer.

U.S. Pat. No. 6,210,279, issued on Apr. 3, 2001, to Peter D. Dickinson, discloses a gaming machine and method using a touch screen.

U.S. Pat. No. 6,283,474, issued on Sep. 4, 2001, to David Guy de Keller, discloses a method for playing a casino game, with rectangular betting areas on a table.

U.S. Pat. No. 6,322,075, issued on Nov. 27, 2001, to Ann DeFranco, discloses a blackjack-type card game, where each player is dealt a four-card array.

U.S. Pat. No. 6,435,505, issued on Aug. 20, 2002, to Arthur Hoffman, discloses a method for playing a game of chance, with indicia including numbers on a playing board, which indicia are distinguishable from the indicia in the instant invention.

U.S. Pat. No. 6,485,020, issued on Nov. 26, 2002, to John Broadnax, discloses a casino card game, with a game board with indicia including numbers. Again, the indicia are readily distinguishable from the indicia in the instant invention.

U.S. Pat. No. 6,523,830, issued on Feb. 25, 2003, to Tsuan Yuan, discloses a casino game, in which the aces may be valued at one or zero.

U.S. Patent Application Publication No. 2002/195775, published on Dec. 26, 2002, by Derek J. Webb and Roger M. Snow, discloses four card poker and associated games, including indicia on a table.

British Patent Application No. 2 239 811, published on Jul. 17, 1991, by Denis Fluen, discloses a betting game, including a game board with numbered play zones, which is played with dice, rather than cards as in the instant invention.

None of the above inventions and patents, taken either singly or in combination, is seen to describe the instant invention as claimed.

SUMMARY OF INVENTION

The present invention is a modified form of low ball poker, in which the generally accepted method of determining the ranking of various low hand values is altered, to create thirteen basic low hands instead of nine. The player is offered the option of placing from five to nine independent bets on each of the nine lowest possible hands from nine low to one low.

Each player receives a four-card hand from a 53-card deck of 52 standard cards plus a joker. The highest-ranking card in these four cards will determine the basic value of each players low hand. The hand can range from a king low (consisting of four kings, the highest and therefore the worst hand) to a one low (consisting of four aces or three aces and the joker, the lowest and therefore the best hand). The joker is always considered an ace.

It is possible to win one independent bet or all independent bets, depending on the highest card held by the player. Payouts range from four to one on the nine low to 2,150 to one on the two low. Aggregate payouts are as high as 2,750 to one for a two low, plus $10,000 for a special fifty-cent bet on the one low (the latter being a payoff of 20,000 to one). Other aggregate payouts range from eleven to one for the eight low to 600 to one for the three low.

All players have an individual betting area, as will be explained below. There is no stress from playing against other players or the dealer. Every player's hand wins or loses on its own merits.

In the first preferred embodiment, each player is provided a separate betting square on which to place his or her independent bets. In the second preferred embodiment, an electronic gaming machine is used, with representations of cards and betting rectangles displayed on a screen, with similar payouts, except for a progressive jackpot for the one low.

For players who have a limited time to play, this game provides one of their very best chances to leave with a huge, meaningful win. It also creates a unique camaraderie among the players. If one player wins the top payout, other players have a chance to win one thousand dollars or more, just for being involved in the hand. This applies even if they loose on their own hand, as will be explained below.

This simple game strives to provide players with more of what they are looking for: an easy game to understand, designed to help them avoid the stressful pitfalls built into the majority of other new games. Lucrative payouts are reasonably possible.

Players have the right to relax and enjoy this fun and excitement as it permeates the playing table. After all, it is their money that makes possible the survival of all casinos. With a certain amount of luck, should not all players have a chance to occasionally walk away a winner?

All winning hands receive multiple payouts. These range from four for one up to 30,000 for one. Payouts are structured somewhat similarly to slot machine payouts. These payouts should supply extra fun and excitement in exchange for the money players place at risk.

The joy of playing the instant invention should exceed that of the slot machines. It is not unusual to place fifteen or twenty bets on a slot machine and receive no action at all in return. Sitting all alone at a slot machine can become a dull and boring activity. This is in vivid contrast to the camaraderie and congeniality existing at most live table games. This is especially true when players do not play against the dealer or each other. In further contrast to the slot machines, players should receive multiple action every four or five bets at this table game. Players also have a chance to win big, if another player wins the top payout. Any losing hand can share in that payout. Why would players not be cheering each other on?

Payouts in the instant invention range from 94% to 96% on the average bets placed at risk. These percentages are consistent for all hands. Payouts on slot machines at major casinos throughout the United States generally range from 90% to 96%. The payouts are very erratic, as a large bulk of payout percentages go into large jackpot payouts. Most slot players fare poorly, unless they hit some of the larger payouts.

The table game of the first preferred embodiment provides each player a betting area with nine separate squares, numbered one through nine. Five equal bets must be placed on squares number nine, eight, seven, six and five. Placing equal bets on squares number four, three or two is optional, as is placing a fifty-cent bet on square number one. Thus, a minimum of five bets is required, and a maximum of nine bets is allowed. It is possible to win any bet or all bets. A bet is won when the highest-ranking card in the four-card hand does not exceed the number on which the bet is placed. A players hand must contain a ten, Jack, Queen or King to lose all bets.

The second preferred embodiment applies the same principles to an electronic gaming device. All bets must be equal bets of one coin, chip or token each. There is a progressive jackpot for the one low bet. The jackpot is accumulated from 90% to 95% of the total proceeds received from the bets placed on the hand of one low. Two low through nine low hands should occur with the same frequency and the same payout percentages as in the first embodiment. A truly random four-card deal, using a 53-card deck containing a joker in the electronic gaming device, will assure the same frequency for all possible hands as in the first embodiment. The result will be an average and very consistent 95% return in payouts. Players should on the average have some winning action every four or five plays. Accordingly, it is a principal object of the invention to enhance the game of low ball poker by altering the generally accepted method of determining the ranking of various low hand values.

It is another object of the invention to provide the players a chance to relax and enjoy themselves.

It is a further object of the invention to provide the players a chance to win large payouts for relatively small bets.

Still another object of the invention is to provide a game with simple rules that will not perplex the players or dealers.

It is an object of the invention to provide improved elements and arrangements thereof in an apparatus for the purposes described which is inexpensive dependable and fully effective in accomplishing its intended purposes. These and other objects of the present invention will become readily apparent upon further review of the following specification and drawings.

BRIEF DESCRIPTION OF DRAWINGS

FIG. 3 is a table showing projected hold on 200 hands with a bet of one dollar ($1.00) on each of squares 2 through 9 and a bet of fifty cents ($0.50) on square 1.

Similar reference characters denote corresponding features consistently throughout the attached drawings.

DETAILED DESCRIPTION

The first preferred embodiment of the present invention is a modified low ball poker game, with a single joker added to a standard deck of 52 cards. In the standard deck the cards have four suits (spades, hearts, diamonds, and clubs) and thirteen ranks (Ace, 2, 3, 4, 5, 6, 7, 8, 9, 10, Jack, Queen, and King) with one card of each suit in each rank. Player's hands consist of four cards, rather than the standard five card poker hands. The dealer receives no hand. The rank of a hand is determined by the card of the highest rank in the hand (with Ace the lowest rank, and King the highest rank, and the joker counting as an Ace). E.g., if a seven is the highest card in a player's hand, the hand is "seven low". Pairs (two cards of the same rank), three or four of a kind (three or four cards of the same rank), straights (cards in sequential rank) and flushes (cards of the same suit) are ignored in determining rank. This modification of the prior art low ball game (in which only straights and flushes are ignored in ranking hands, but not pairs, or three or four of a kind) increases the number of possible basic low ball hands from nine (5 low, 6 low, 7 low, 8 low, 9 low, 10 low, Jack low, Queen low, and King low) to thirteen by the additional possible basic low ball hands of 4 low, 3 low, 2 low, and 1 low (four aces or three aces and the joker).

Figure 1:
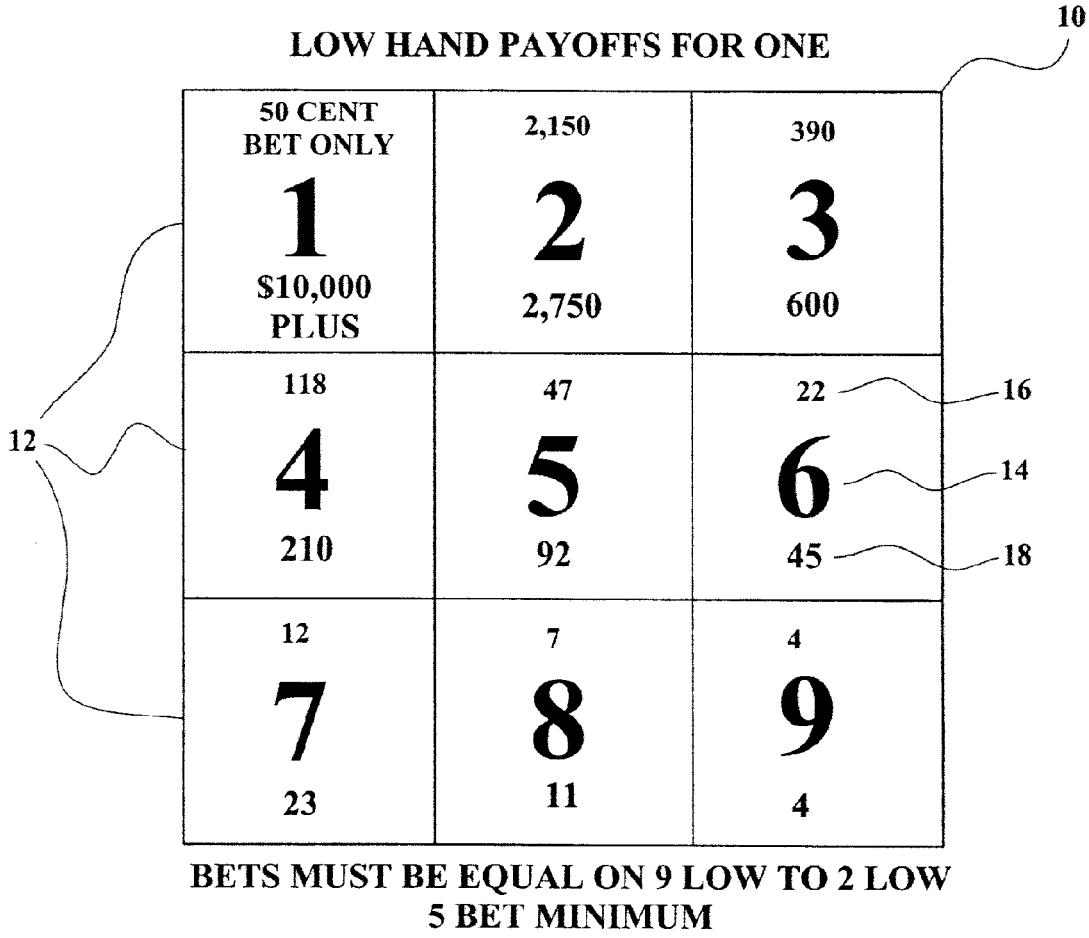
FIG. 1 is a top plan view of the betting area for a player in the first preferred embodiment of the invention.
Figure 4:
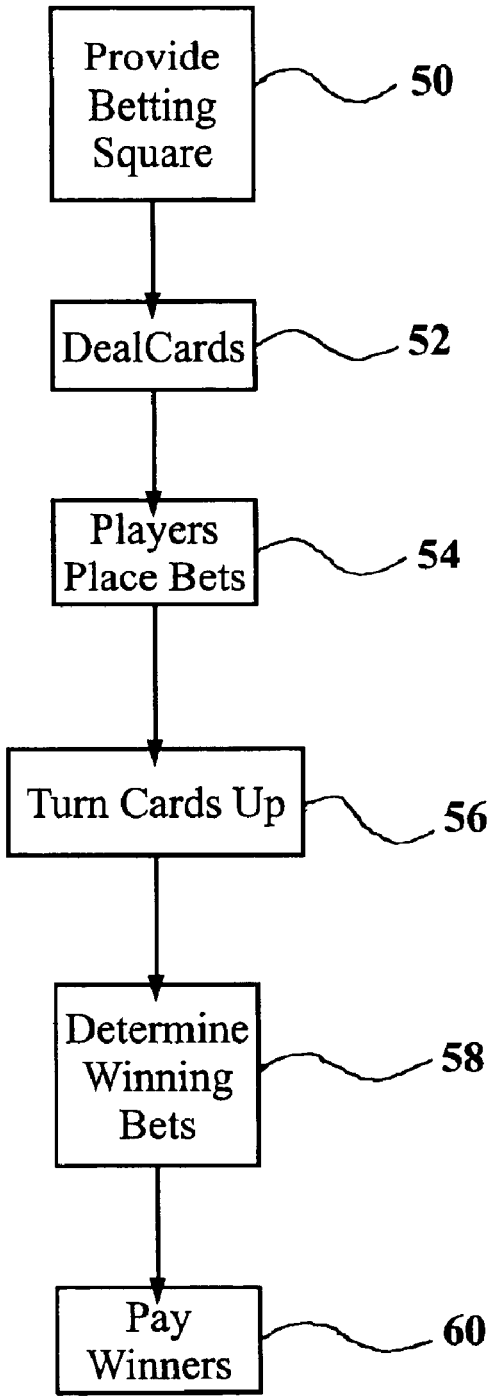
FIG. 4 is a flowchart summarizing the steps in the first preferred embodiment of the invention.

In the first preferred embodiment, the game is played on a casino table similar to a blackjack table, with a dealer's area and six designated betting areas to accommodate one to six players. Each player's betting area will include one large square 10 divided into nine smaller squares 12, numbered 1 through 9, representing 1 low through 9 low, as depicted in FIG. 1. (Each square represents a hand of the same number. Providing the betting square 50 is the first step shown in FIG. 4.) Each square has a numeral 14 in large type in its center, and upper indicia 16 and lower indicia 18 in smaller type. Each large square may be printed on a piece of paper or other movable material, or painted, engraved or otherwise permanently affixed to the surface of the table. Each player must place a minimum of five equal bets in square 5 through square 9. (The bets may be made by placing chips, tokens or actual money on the squares.) Bets in the same equal amount on any one, two, or all three of squares 2, 3 and 4 are optional. In addition, each player has the option of placing a fifty cent bet on square 1. (A different fixed amount may be substituted by the house for square 1.) All bets on squares 2 through 9 may be required to be within minimum and maximum limits that may be posted on the casino table.

Square 1 has upper indicia stating "50 CENT BET ONLY" and lower indicia stating "$10,000 PLUS". The payout for a bet on square 1 is always $10,000 plus 2,750 times the amount bet on any other square by the winning player. (A winning bet on square 1 is considered a winning bet on all squares, and thus is paid the cumulative amount of a bet on all of squares 2 through 9.) In addition, when there is a winner on square 1, all other players who placed non-winning bets on square 1 receive equal shares of a $5,000 bonus payout. E.g., if one player placed a winning bet on square 1, and five other players placed non-winning bets on square 1, each of the other players would receive $1,000 of the bonus payout. (The house may substitute different fixed amounts for $10,000 and $5,000.) The dealer first deals four cards face down to each player. (52 in FIG. 4.) The players then place their bets. (54 in FIG. 4.) The dealer turns each hand over (56 in FIG. 4), and picks up all losing hands and bets from the table. The dealer places a marker on each winning square, and verifies the amount bet on that square by each winning player. (58 in FIG. 4.) Next the dealer pays off the winning bets on squares 2 through 9 by multiplying the amount of the equal bet placed in each square by the lower number in the square corresponding to the value of the hand. If there is a winner on square 1, the dealer pays the winner $10,000 plus 2,750 times the equal bet placed by the winner on any other squares, and divides the $5,000 bonus payout among any other players who placed a bet on square 1. (60 in FIG. 4.) Finally, the dealer picks up the hands and bets of the winning players.

Figure 2:
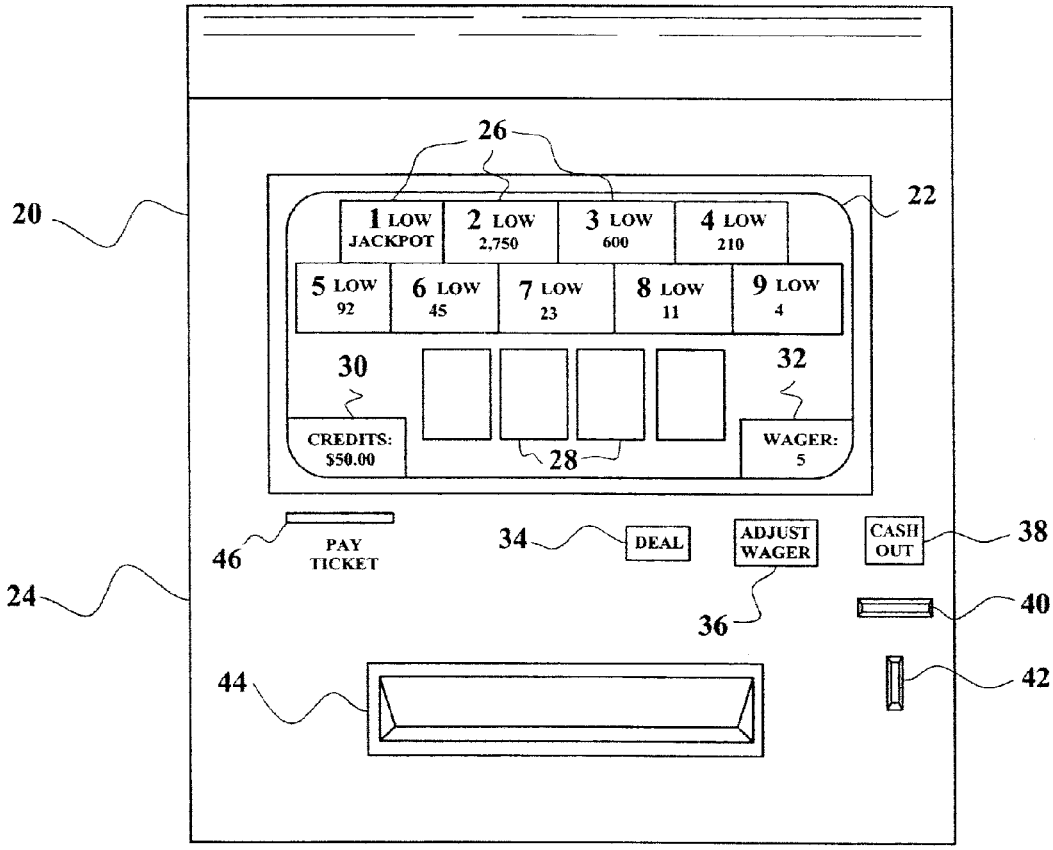
FIG. 2 is a front elevational view of the electronic gaming machine in the second preferred embodiment of the invention.
Figure 5:
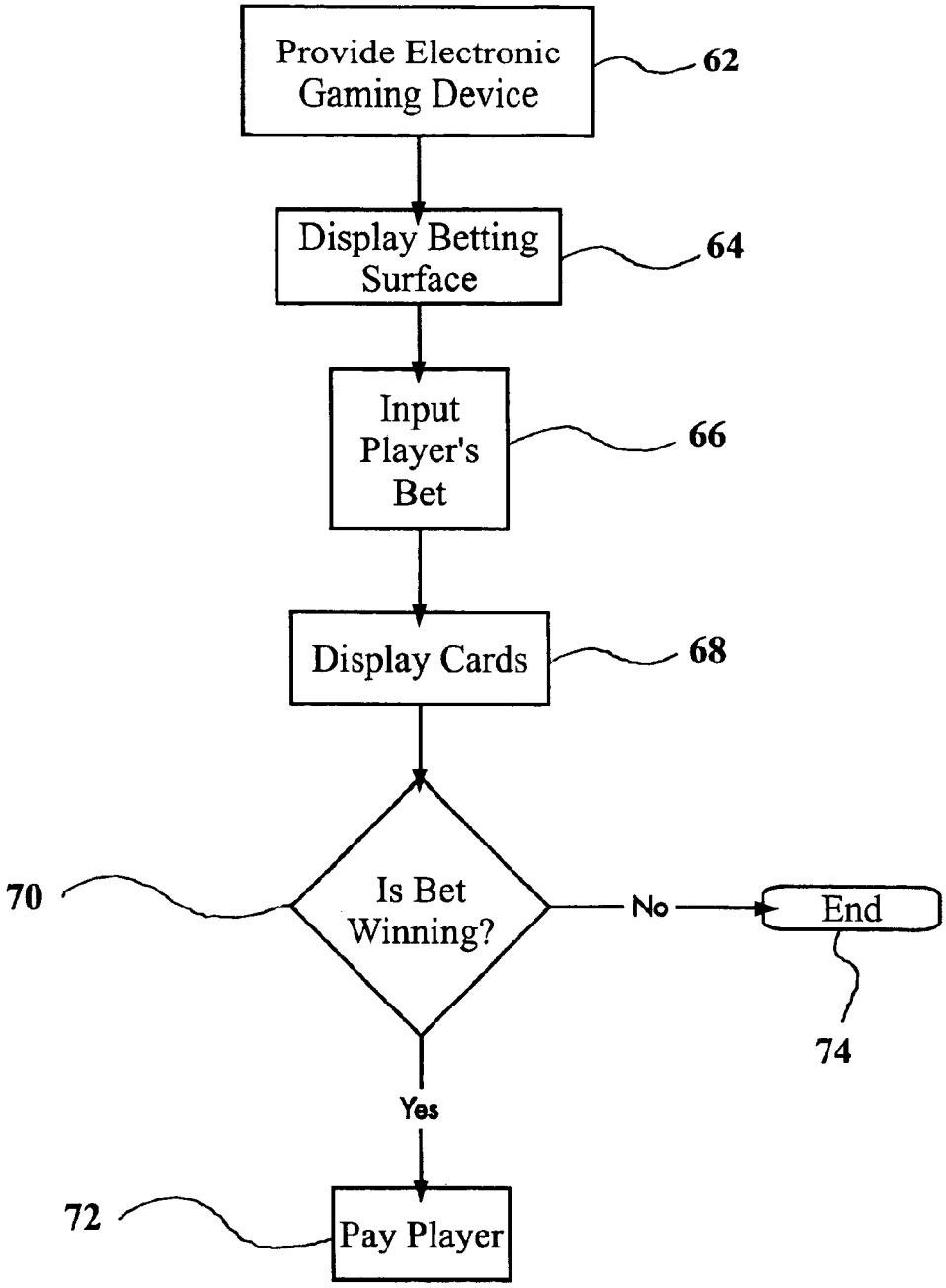
FIG. 5 is a flowchart summarizing the steps in the second preferred embodiment of the invention.

The second preferred embodiment of the invention is played on electronic gaming device 20, including a display screen 22, as shown in FIG. 2. (Providing the electronic gaming device 62 and displaying the betting surface 64 are the first two steps shown in FIG. 5.) A processor and memory (not shown in the drawings) may be enclosed within housing 24, or the device may be networked to an external processor and memory. All rules for payouts are the same as for the first embodiment, except for rectangle 1 on which there is a progressive jackpot payout. Rectangles 26 corresponding to the squares for 1 low through 9 low in the first preferred embodiment are displayed in the upper half of the screen. There is a four card display area 28 in the middle of the lower half of the screen. The player's credits are displayed in the lower left corner 30 and wager amount is shown in the lower right corner 32. A deal button 34 is depressed to start the hand. A wager change button 36 is provided to alter the number of coins wagered, within the limits of a five-coin minimum and a nine-coin maximum. A cash out button 38 is also provided, with a currency insertion slot and validator 40, a coin slot 42, and a coin trough 44. A pay ticket ejection slot 46 is also included, as many casinos have gone to the system of cashing out pay tickets for player's winnings. Any use of coins may be eliminated, with pay tickets dispensed to players to cash out at the casino's cashier's window. Paper money may be inserted in the currency insertion slot, and is ejected if it is not validated. The coin slot may be obsolete, but is shown for completeness.

The number of the player's wager displayed in the lower right corner of the screen is initially is "5", and a warning message is displayed in the lower right corner when the player's credits are not five times a minimum unit. When the adjust wager button is pressed once, the number of the player's wager displayed is changed to "4", and a warning message is displayed if the player's credits are not six times a minimum unit. When the adjust wager button is pressed twice, the number of the player's wager displayed is changed to "3", and a warning message is displayed if the player's credits are not seven times a minimum unit. When the adjust wager button is pressed thrice, the number of the player's wager displayed is changed to "2", and a warning message is displayed if the player's credits are not eight times a minimum unit. When the adjust wager button is pressed four times, the number of the players player's wager displayed is changed to "1", and a warning message is displayed if the player's credits are not nine times a minimum unit. (Inputting the player's bet 66 is the third step shown in FIG. 5.) The warning message is removed when the player's credits have been increased to the required multiple of the minimum unit, by the insertion of currency or coins into said slots. When the deal button is pressed, a warning message is displayed if the player's credits are less than the required multiple of the minimum unit, else the representations of the cards are displayed in a fourth area of the display screen. (68 in FIG. 5.) If the player has placed a winning bet and the number of the wager is greater than 1, the machine pays the player the minimum FIG. 3 shows expected results for 200 hands of betting one dollar on squares 2 through 9 (this applies to both the first and second preferred embodiments) and of betting fifty cents on square 1 (the results for square 1 only apply to the first preferred embodiment).

It is to be understood that the present invention is not limited to the embodiments described above, but encompasses any and all embodiments within the scope of the following claims.

What is claimed is:

1. A method of playing a card game, comprising the steps of:

providing each player a betting surface divided into areas on which bets can be placed for cards of different ranks;

dealing a plurality of cards face down to each of one or more players, said cards being dealt from a deck wherein the cards have a plurality of ranks;

a single interval of betting by the players, each player placing at least one bet that the highest card of all the cards in the player's hand will have a certain rank;

turning the cards face up;

determining which players have placed winning bets, without regard to whether or not there are a pair, three or four of a kind, a flush or a straight in the players' hands; and paying off each player who has placed a winning bet by a predetermined amount, with bets on cards having lower ranks having higher payoffs;

wherein the number of cards dealt to each player is four;

the cards are dealt from a deck of at least 52 playing cards, including thirteen cards in each of four suits, with one card in each suit having the rank of Ace, 2, 3, 4, 5, 6, 7, 8, 9, 10, Jack, Queen, and King;

the cards are ranked in order from lowest to highest: Ace, 2, 3, 4, 5, 6, 7, 8, 9, 10, Jack, Queen, and King, with the Ace counting as 1;

with the areas on the betting surface having indicia indicating the rank bet on, and the payoff for a winning bet;

the payoff for a winning bet on a rank including the payoffs for winning bets on all higher ranks;

there is no payoff for ranks above a first specified rank, and the betting surface does not have areas for the ranks on which there is no payoff; and the players are required to bet on all ranks from a second specified rank to the first specified rank, and may bet on ranks below the second specified rank, said second specified rank being lower than the first specified rank.

2. The method of playing a card game according to claim 1, wherein:

the deck includes at least one joker, which counts as an Ace.

3. The method of playing a card game according to claim 2, wherein:

the deck has 53 cards, including only one joker.

4. The method of playing a card game according to claim 3, wherein:

the betting surface is a large square, said betting square being divided into nine smaller squares numbered 1 through 9, arranged in three rows and three columns, with each square having a large numeral in its center, said numeral being the number of the square, with upper indicia above the numeral, and lower indicia below the numeral, said upper and lower indicia being in smaller characters than the number, with square 1 having "X BET ONLY" above (wherein X is a first credit or currency amount) and "Y PLUS" below (wherein Y is a second credit or currency amount), and squares 2 through 9 having upper indicia that is a number indicating the payout for the square, and lower indicia that is a number indicating the cumulative payout for the square and all the squares with higher numbers;

each player places a bet in an equal amount on each of squares 5 through 9, each player having the option of placing a bet in the same amount on squares 2, 3 or 4, and each player having the option of placing a bet of X on square 1;

a bet is a winning bet when the number of the square on which it was placed is equal to the highest card dealt to the player who placed the bet;

each player who has placed a winning bet on a square (other than square 1) is paid the amount of the bet times the number of the lower indicia on the square;

each player who has placed a winning bet on square 1 is paid Y, plus 2,750 times the amount of the bet on the ninth square; and when at least one player has placed a winning bet on square 1, each player who has placed a non-winning bet on square 1 is paid z (wherein Z is a third credit or currency amount) divided by the number of players who placed non-wining bets on square 1.

5. A method of playing a card game, comprising the steps of:

providing an electronic gaming device to a player;

displaying a betting surface divided into areas representing bets that can be placed;

inputting, in a single interval of betting, at least one bet by the player that the highest card of all the cards in his hand will have a certain rank;

displaying representations of several different cards to the player, said representations being randomly selected from a fixed number of possible representations of cards having a plurality of ranks;

determining whether the player has placed a winning bet, without regard to whether or not there are a pair, three or four of a kind, a flush or a straight in the player's hand; and if player has placed a winning bet, paying off the player by a predetermined amount, with bets on cards having lower ranks having higher payoffs:

wherein the number of representations of cards displayed is four;

the representations are selected from at least 52 possible representations of playing cards, including thirteen cards in each of four suits, with one card in each suit having the rank of Ace, 2, 3, 4, 5, 6, 7, 8, 9, 10, Jack, Queen, and King;

the cards are ranked in order from lowest to highest: Ace, 2, 3, 4, 5, 6, 7, 8, 9, 10, Jack, Queen, and King, with the Ace counting as 1;

the areas on the betting surface have indicia indicating the rank bet on, and the payoff for a winning bet;

the payoff for a winning bet on a rank includes the payoffs for winning bets on all higher ranks;

there is no payoff for ranks above a first specified rank, and the betting surface does not have areas for the ranks on which there is no payoff; and the player is required to bet on all ranks from a second specified rank to the first specified rank, and may bet on ranks below the second specified rank, said second specified rank being lower than the first specified rank.

6. The method of playing a card game according to claim 5, wherein:

the possible representations includes at least one representation of a joker, which counts as an Ace.

7. The method of playing a card game according to claim 6, wherein:

there are 53 possible representations of playing cards, including only one joker, each of which have an equal probability of being selected.

8. The method of playing a card game according to claim 7, wherein:

the electronic gaming device has a processor, a memory, a display screen, a deal button, an adjust wager button, a cash out button, a currency insertion slot and a coin insertion slot for inputting monetary value, and a coin trough and a pay ticket slot for outputting monetary value;

the betting surface is a first area of the display screen nine rectangles numbered 1 through 9, and within each rectangle a large numeral followed by the word "LOW", said numeral being the number of the rectangle, and lower indicia in smaller characters below the numeral, with rectangle 1 having the word "JACKPOT" as its lower indicia, and rectangles 2 through 9 having lower indicia that is a number indicating the cumulative payout for the rectangle and all the rectangles with higher numbers;

a second area of the display screen displays the amount of the player's credits;

a third area of the display screen displays the number of the player's wager, which initially is "5", and displays a warning message when the player's credits are not five times a minimum unit;

when the adjust wager button is pressed once, the number of the player's wager displayed is changed to "4", and a warning message is displayed if the player's credits are not six times a minimum unit;

when the adjust wager button is pressed twice, the number of the player's wager displayed is changed to "3", and a warning message is displayed if the player's credits are not seven times a minimum unit;

when the adjust wager button is pressed thrice, the number of the player's wager displayed is changed to "2", and a warning message is displayed if the player's credits are not eight times a minimum unit;

when the adjust wager button is pressed four times, the number of the player's wager displayed is changed to "1", and a warning message is displayed if the player's credits are not nine times a minimum unit;

the warning message is removed when the player's credits have been increased to the required multiple of the minimum unit, by the insertion of currency or coins into said slots;

when the deal button is pressed, a warning message is displayed if the player's credits are less than the required multiple of the minimum unit, else the representations of the cards are displayed in a fourth area of the display screen;

if the player has placed a winning bet and the number of the wager is greater than 1, paying the player the minimum unit times the number of the lower indicia on the rectangle having the number of the wager; and if the player has placed a winning bet and the number of the wager is 1, paying the player a jackpot.

* * * * *